US009482033B2

(12) United States Patent
Loreti

(10) Patent No.: US 9,482,033 B2
(45) Date of Patent: Nov. 1, 2016

(54) ANTI-SHOCK ELECTROMECHANICAL LOCK

(71) Applicant: RIELDA SERRATURE S.r.l., Fiumicino (RM) (IT)

(72) Inventor: Alberto Loreti, Rieti (IT)

(73) Assignee: RIELDA SERRATURE S.R.L., Fiumicino (RM) (IT)

( * ) Notice: Subject to any disclaimer, the term of this patent is extended or adjusted under 35 U.S.C. 154(b) by 245 days.

(21) Appl. No.: 14/135,303

(22) Filed: Dec. 19, 2013

(65) Prior Publication Data

US 2014/0183880 A1 Jul. 3, 2014

(30) Foreign Application Priority Data

Dec. 20, 2012 (IT) ..... TO2012A1114

(51) Int. Cl.
*E05B 47/00* (2006.01)
*E05B 47/06* (2006.01)

(52) U.S. Cl.
CPC ..... *E05B 47/0002* (2013.01); *E05B 47/063* (2013.01); *E05B 2047/0093* (2013.01); *Y10T 292/1021* (2015.04)

(58) Field of Classification Search
CPC ..... E05B 47/063; E05B 47/0012; E05B 47/0006; E05B 47/0661; E05B 47/0673; E05B 47/0642; E05B 47/0001; E05B 2047/0079; E05B 2047/0085; E05B 27/0057; E05B 47/0002; E05B 47/0634; E05B 2047/0093; E05B 47/00; E05B 47/0623; Y10T 70/7102; Y10T 70/7621; Y10T 70/7915
USPC ..... 70/278.1, 278.3, 278.7; 292/144
See application file for complete search history.

(56) References Cited

U.S. PATENT DOCUMENTS 6,155,089 A * 12/2000 Hurskainen ..... E05B 47/0623 70/187

(Continued)

FOREIGN PATENT DOCUMENTS

| | | | |
|---|---|---|---|
| DE | 19704062 | A1 | 8/1998 |
| DE | 102006024063 | A1 | 11/2007 |
| WO | 2004/072418 | A1 | 8/2004 |

OTHER PUBLICATIONS

Italian Search Report dated Oct. 11, 2013.

*Primary Examiner* — Suzanne Barrett
(74) *Attorney, Agent, or Firm* — Hedman & Costigan, P.C.; James V. Costigan; Kathleen A. Costigan

(57) ABSTRACT

The present invention concerns an electromechanical lock (1), comprising:
- a solenoid (2)
- a movable locking element (3) displaceable by said solenoid (2) into an unlocking position of the lock (1)
- a spring (4) acting on said movable element (3) to hold it in a locking position of the lock (1) with the solenoid (2) in a de-energized condition wherein said movable element (3) comprises an anti-shock shaped portion (31,31',31",31'") and said lock (1) comprises an engagement means (8,8',8",8'") for said anti-shock shaped portion, said engagement means (8,8',8",8'") is displaceable into an engagement position in which it interferes with the anti-shock shaped portion (31,31',31", 31'") in order to prevent said movable element (3) from displacing into the unlocking position of the lock wherein said lock it further comprises
- a substantially cylindrical and hollow rotor (6), intended to house said solenoid (2) and said movable element (3) such that one end of the latter provided with said anti-shock shaped portion (31) externally protrudes from said solenoid (2)
- a fixed block or stator (9)
- a stop bar (81) radially displaceable from and towards an interference position between rotor (6) and stator (9) to allow or prevent rotation of the former with respect to the latter.

8 Claims, 6 Drawing Sheets

(56) References Cited

U.S. PATENT DOCUMENTS 6,370,928 B1 * 4/2002 Chies ..... E05B 47/0642 70/278.2
6,382,003 B1 * 5/2002 Watanuki ..... B60R 25/04 70/184
6,412,321 B1 * 7/2002 Aramburu ..... E05B 47/0012 70/278.3
6,718,806 B2 * 4/2004 Davis ..... E05B 15/0053 70/223
7,673,483 B2 * 3/2010 Flandrinck ..... B60R 25/021 70/252
7,845,202 B2 * 12/2010 Padilla ..... E05B 9/086 70/278.1
7,966,854 B2 * 6/2011 Imedio Ocana .... E05B 47/0642 192/69.62
8,544,303 B2 * 10/2013 Andersson ..... E05B 27/0082 70/278.3
8,720,238 B1 * 5/2014 Davis ..... E05B 43/005 70/278.7
2001/0027671 A1 10/2001 Davis
2002/0134120 A1 * 9/2002 Davis ..... E05B 47/063 70/278.3
2002/0189307 A1 * 12/2002 Gokcebay ..... G06K 19/04 70/278.3
2005/0252260 A1 * 11/2005 Chu ..... E05B 47/0009 70/278.7
2006/0156771 A1 * 7/2006 Hauri ..... E05B 47/0649 70/278.7
2006/0213240 A1 * 9/2006 Krisch ..... E05B 47/0649 70/278.7
2007/0044523 A1 * 3/2007 Davis ..... E05B 17/0058 70/34
2009/0165513 A1 * 7/2009 Bellamy ..... E05B 47/0011 70/278.7
2011/0067465 A1 * 3/2011 Luo ..... E05B 47/063 70/278.7
2012/0324969 A1 * 12/2012 Goldman ..... E05B 47/0615 70/283
2013/0014552 A1 * 1/2013 Bench ..... E05B 47/0673 70/278.7
2014/0345963 A1 * 11/2014 Ferri ..... B62D 25/10 180/274

* cited by examiner

ANTI-SHOCK ELECTROMECHANICAL LOCK

TECHNICAL FIELD

The present invention relates to the field of electromechanical locks; this term is intended to indicate those locks equipped with a movable locking element displaced by a solenoid, in turn activated by an unlocking electrical signal.

STATE OF THE ART

In the electromechanical locks the movable element cooperates with the operating elements of the lock that control the bolt and that vary depending on the types of locks.

In general, in these locks the movable element is stably held in the locking condition of the lock thanks to a spring.

When the unlocking electrical signal (which can be generated by a key provided with an electrical battery or by an electrical circuit connected to a control button) is imparted to the solenoid, this latter acts on the movable element bringing it into the unlocking condition of the lock.

This condition is maintained until the electrical signal that energizes the solenoid continues; when the electrical signal ceases, the movable element is brought back to the locking condition of the lock exactly thanks to the spring and there it remains until a new unlocking signal is generated.

The main object in this technical field is obviously to realize devices that are resistant to opening attempts with dexterity by shock.

Unfortunately, because of their peculiarity, electromechanical locks prove to be easily subject to opening with dexterity by shock.

This opening is carried out in some cases, such as when a pulse force (hit with a hammer or the like, or a series of hits proximate in time) is applied directed along the axis of the movable element controlled by the solenoid that manages to gradually displace with micro-movements against the force of its spring due to the friction of the bolt permanently in traction on the movable element until causing the opening or unlocking condition; or such as when a pulse force (hit with a hammer or the like, or a series of hits proximate in time) is applied directed along the axis of the movable element controlled by the solenoid or along another axis even at the same time so that due to the produced friction manages to gradually move with micro-movements the movable element until creating the opening or unlocking condition.

These types of openings allow to close again the electromechanical locks afterward without causing any damage to their functioning nor leaving signs of the occurred opening thus making it impossible to ascertain that there was an opening with dexterity by a third party.

OBJECTS AND SUMMARY OF THE INVENTION

It is an object of the present invention to overcome the disadvantages of the known art.

In particular, it is an object of the present invention to provide an electromechanical lock equipped with expedient devices suitable for preventing openings with dexterity by shock.

These and other objects of the present invention are achieved by a lock incorporating the features of the appended claims, which form integral part of the present description.

The idea on which the present invention is based consists in realizing an electromechanical lock comprising:

- a solenoid
- a movable locking element displaceable by the solenoid into an unlocking position of the lock
- a spring acting on said movable element to hold it in the locking position of the lock with the solenoid in a de-energized condition.

The movable element comprises an anti-shock shaped portion and the lock comprises an engagement means for said shaped portion. Said engagement means by displacing interferes with the anti-shock shaped portion preventing the movement of the movable element for opening or unlocking the lock.

Furthermore, the lock of the invention also comprises a substantially cylindrical and hollow rotor, intended to house said solenoid and said movable element such that one end of the latter provided with said anti-shock shaped portion externally protrudes from said solenoid; the lock also comprises a fixed block or stator and a stop bar radially displaceable from and towards an interference position between rotor and stator to allow or prevent rotation of the former with respect to the latter.

In this way the drawbacks linked to the known electromechanical locks are advantageously overcome, since the anti-shock feature prevents the fact that the lock of the invention can be brought into the unlocking condition by simply applying pulse forces and/or of another type.

Further objects and advantages of the present invention will become more clear from the following description.

BRIEF DESCRIPTION OF THE DRAWINGS

The invention will be described hereinbelow with reference to non-limiting examples, which are given for explanatory and not-limiting purposes in the appended drawings. These drawings illustrate different aspects and embodiments of the present invention and, where appropriate, reference numbers illustrating structures, components, materials and/or similar elements in different figures are denoted by similar reference numbers.

DETAILED DESCRIPTION OF THE INVENTION

Figures 1, 2:
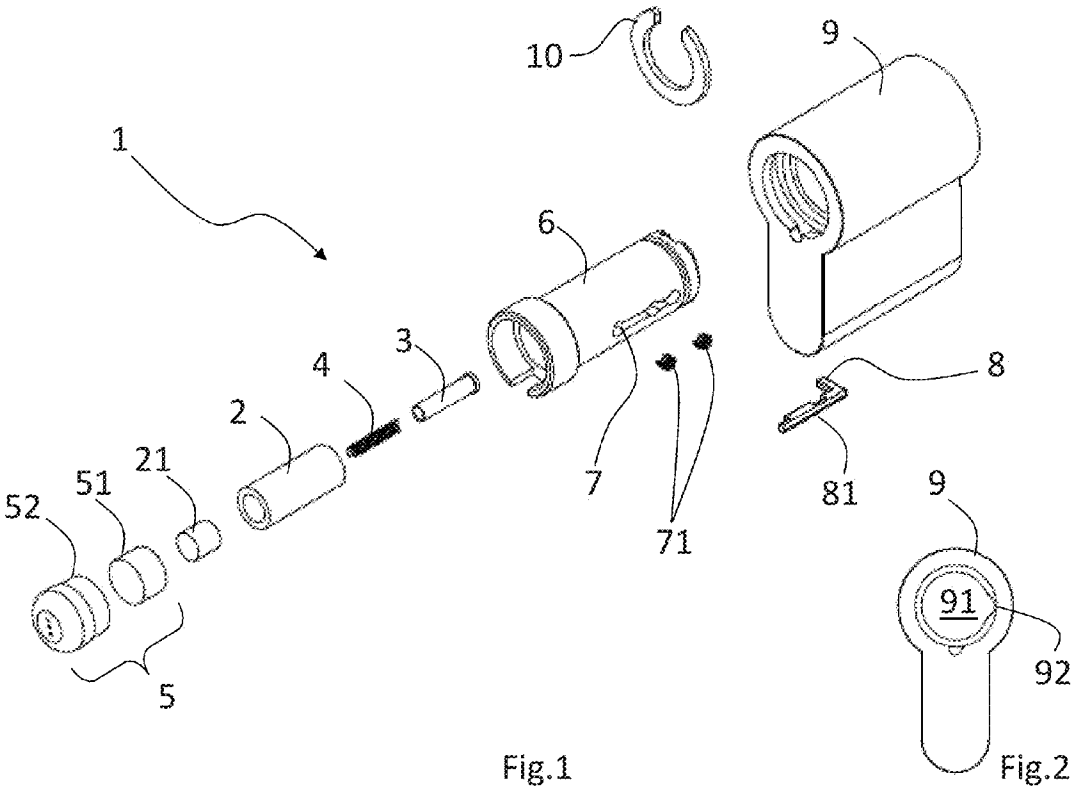
FIG. 1 shows an exploded view of a first embodiment of a lock according to the invention.
FIG. 2 shows a front view of the lock of the previous figure.

While the invention is susceptible of various modifications and alternative constructions, some illustrated relevant embodiments are shown in the drawings and will be described hereinbelow in detail. It should be understood, however, that there is no intention to limit the invention to the specific illustrated embodiment, but, on the contrary, the invention intends to cover all the modifications, alternative constructions, and equivalents that fall within the scope of the invention as defined in the claims.

The use of "e.g.", "etc.", "or" indicates non-exclusive alternatives without limitation unless otherwise indicated. The use of "comprises" means "comprises, but is not limited to" unless otherwise indicated.

In general, with reference to all the embodiments described hereinbelow by way of example, the basic concept of the invention is related to the fact that there is provided an electromechanical lock 1 comprising:

- a solenoid 2
- a movable locking element 3 displaceable by said solenoid 2 into an unlocking position of the lock 1
- a spring 4 acting on said movable element 3 to hold it in a locking position of the lock 1 with the solenoid 2 in a de-energized condition, wherein the movable element 3 comprises an anti-shock shaped portion 31,31',31", 31'" and the lock 1 comprises an engagement means 8,8',8",8'" for said anti-shock shaped portion, said engagement means 8,8',8",8'" being displaceable into an engagement position in which it interferes with the anti-shock shaped portion 31,31',31",31'" in order to prevent said movable element 3 from displacing into the unlocking position of the lock.

The electromechanical locks 1 that are shortly going to be described in detail preferably have the anti-shock shaped portion 31,31',31",31'" of the movable element 3 that comprises first abutment surfaces and the engagement means 8,8',8",8'" that comprises second abutment surfaces to realise a mechanical interference between the movable element 3 and the engagement means 8,8',8",8'" itself, so as to engage the movable element 3 and to retain it in the locking position of the lock.

Advantageously, the movable element 3 is the movable core of said solenoid 2 and has a substantially cylindrical shape with two free ends, a first end being intended to cooperate with the spring 4 and the opposite end being provided with said anti-shock shaped portion 31,31',31", 31'".

According to a feature of the present invention, the lock 1 further comprises

- a substantially cylindrical and hollow rotor 6, intended to house said solenoid 2 and said movable element 3 such that one end of the latter provided with said anti-shock shaped portion 31 externally protrudes from said solenoid 2
- a fixed block or stator 9
- a stop bar 81 radially displaceable from and towards an interference position between rotor 6 and stator 9 to allow or prevent rotation of the former with respect to the latter.

FIG. 1 shows an exploded view of a first embodiment of a lock according to the invention, denoted as a whole with the reference numeral 1.

The lock 1, in this non-limiting example, comprises a solenoid 2 having an fixed end element 21, a spring 4 and a movable element 3 intended to slide in the solenoid 2 like a movable core.

The particular arrangement of the parts causes that, with the solenoid 2 in a de-energized condition, the movable element 3 is pushed away from the fixed end element 21, which also acts as an abutment for the spring 4.

When the solenoid 2 is energized by an electrical signal, the generated magnetic field causes the movable element 3 to move in the direction of the fixed end element 21, compressing the spring 4.

This situation is maintained until the energized condition of the solenoid 2 is maintained, once ceased which the spring 4 pushes again the movable element 3 in the opposite direction.

Figure 6:
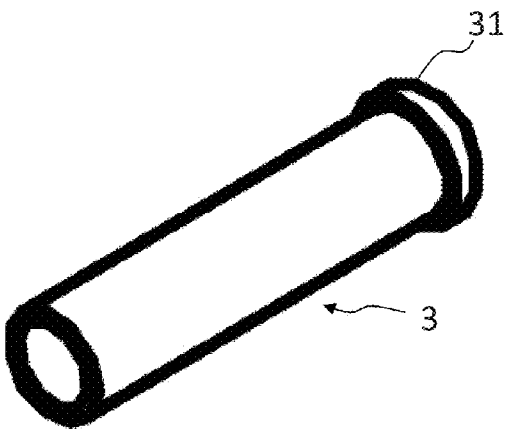
FIG. 6 shows another detail of the lock of the preceding figures.

With reference to FIG. 6, the movable element 3 is equipped with an anti-shock shaped portion: in this example the movable element has a cylindrical body ending with an enlarged head that is, exactly, the anti-shock shaped portion 31.

The movable element 3 is mounted in the solenoid 2 such that its enlarged head 31 protrudes externally from the latter.

The lock 1 further comprises a control unit 5, in particular an electronic control unit, operatively connected to the solenoid 2 and in turn comprising an electronic card 51 and a connector element 52 optionally provided with an anti-drilling protection, such as a high-hardness metal disc or the like.

The lock 1 further comprises a substantially cylindrical and hollow rotor 6, intended to house in an assembled condition the solenoid 2 and the control unit 5.

On the body of the rotor 6, substantially along one of the directrixes thereof, a seat 7 intended to house at least one, preferably two springs 71 radially arranged with respect to the rotor 6, is obtained.

The lock further comprises a stop bar 81 having, in this example, a "L" shape partly mounted in the seat 7 and radially pushed (in the assembled condition) towards outside by the springs 71.

The stop bar 81 comprises a substantially cylindrical body from which a bent end portion departs, arranged in a substantially perpendicular way with respect to the body.

The body of the stop bar 81 is intended to prevent/allow the rotation of the rotor 6 depending on the position that it assumes with respect to the seat 7 (as it is shortly going to be described in greater detail), while the bent end portion of the stop bar 81, arranged in a radial direction, is, in this example, the engagement means 8 that cooperates with the anti-shock shaped portion 31, as it is shortly going to become apparent.

The set of parts just described is housed overall in a fixed block or stator 9 and held therein by the stop washer 10.

To this purpose, the stator 9 is provided with a substantially cylindrical through hole 91 in which the rotor 6 is housed and with a cavity 92 in which, in the assembled condition, the stop bar 81 is placed; the cavity 92 extends into the body of the stator 9 in the radial direction departing from the through hole 91, as visible in the detail of FIG. 2.

Figure 4:
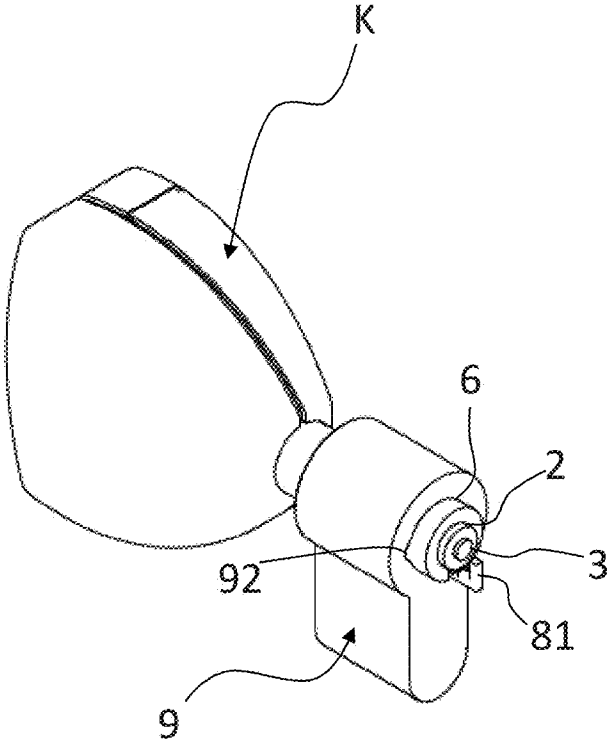
FIGS. 3 and 4 show two phases of an opening with an electronic key of the lock of FIG. 1.
Figure 3:
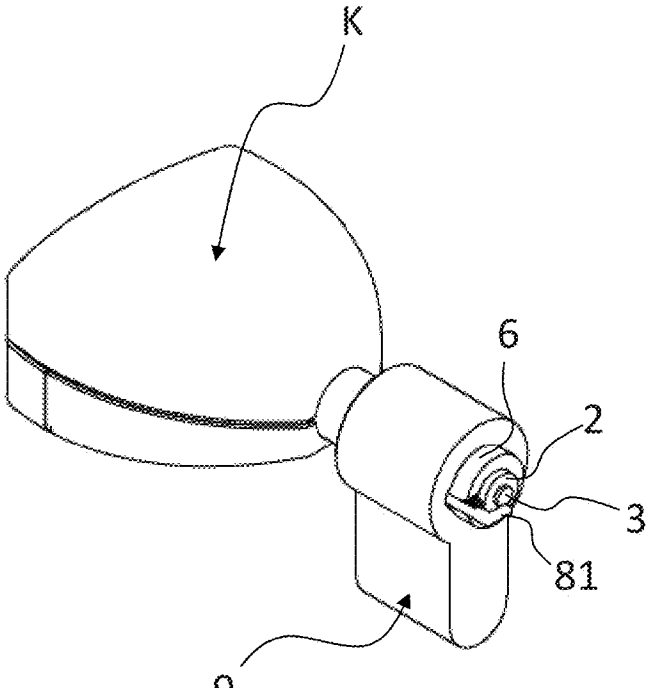
Figure 5:
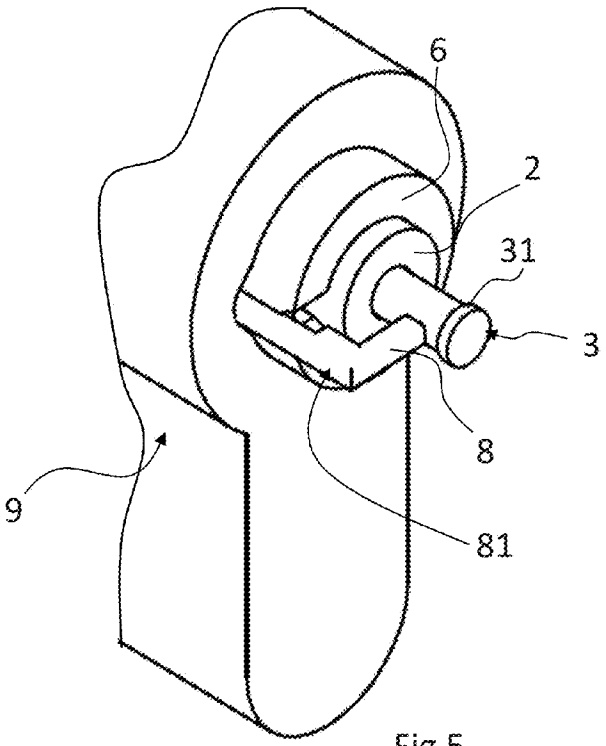
FIG. 5 shows a detail of the lock of the preceding figures.

Reference is made to FIGS. 3 and 4 to understand the functioning during the opening with a key K, and reference is made to FIG. 5 to observe the condition in which the lock 1 is locked.

Starting from this latter condition, it is noted that the movable element 3, under the action of the spring 4, is in the condition extracted from the solenoid and protrudes until being placed in front of the head 8 of the stop bar 81.

This latter is housed in the cavity 92 previously described and, in this position, locks any rotation of the rotor 6 with respect to the stator 9, creating an obstacle to the relative rotation of the two parts because it is arranged on the rotation circumference.

A radial displacement of the stop bar 81 is moreover prevented, in this condition, by the movable element 3, which is placed in front of the end portion 8 of the bar 81 and thus prevents the radial movement thereof.

The lock 1 is thus locked or closed.

When one wishes to open the lock 1 without forcing it, the corresponding key K is used.

The key K, which is an electronic key in this example, is internally provided with an electronic circuit and a battery and it is intended to be connected to the connector element 52 through which it transmits an opening signal to the electronic card 51, which is then transmitted as an electrical unlocking signal to the solenoid 2.

It is to be noted as of now that, in certain situations, in place of the key K a control circuit could be used, which circuit acts on the solenoid and can be actuated by means of a button, without for this reason that the principle of the invention deviates from what herein taught.

In another embodiment (not shown) the key K is a traditional key that, when used, does not directly act on the lock in a mechanical way, but it actuates an electrical control circuit that acts on the solenoid.

Returning to FIG. 3, the key K during an opening phase is observed: in this figure the electrical signal energizing the solenoid 2 has already been transmitted and it continues until the key K is connected to the connector 52.

The energization of the solenoid 2 has caused the displacement to the unlocking position of the movable element 3, which in fact in FIG. 3 is displaced to that position: it is in fact moved back (towards the key K) from the initial extended position (see FIG. 5) in which it was before the unlocking signal.

The displacement of the movable element 3, therefore, frees the space needed for the radial movement towards the center of the stop bar 81, which takes place thanks to the rotation of the key K: the rotation of the key K causes, in fact, the rotation of the rotor 6; the stop bar 81, no longer impeded by the movable element 3, is free to radially move inwards protruding from the cavity 92 (due to the rotation), pushed in this direction from the walls of the cavity 92 itself during the movement, and being partially housed in the seat 7.

The rotor 6, no longer impeded by the stop bar 81, is then free to rotate, until placing into the configuration of FIG. 4, in which the lock is unlocked or open.

Figure 7:
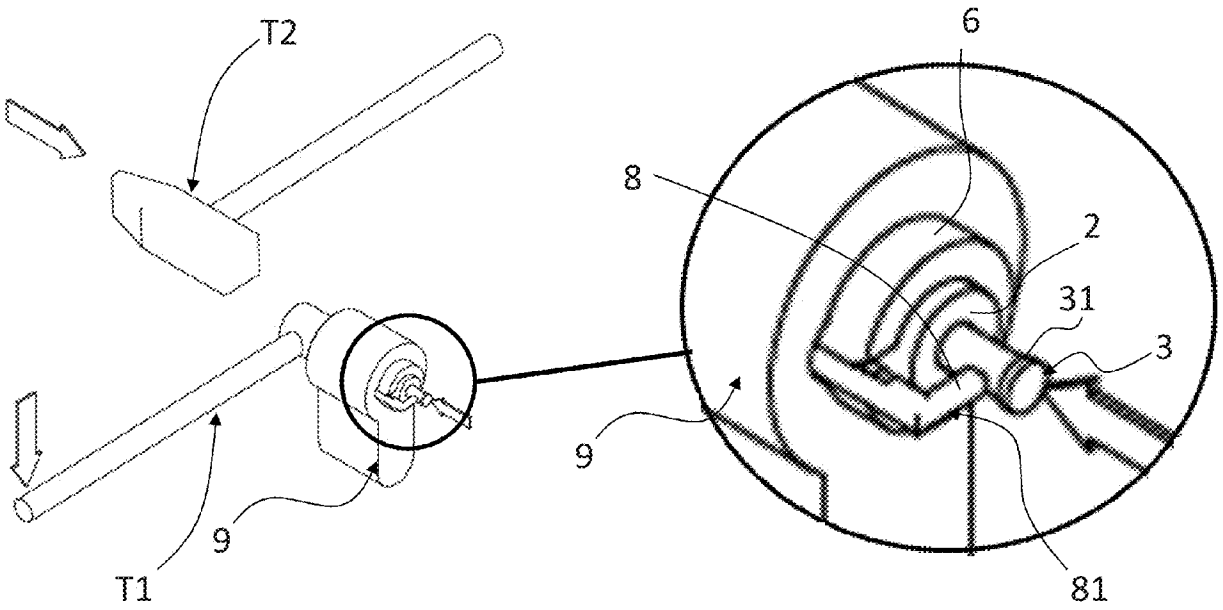
FIG. 7 shows an opening attempt with dexterity by shock of the lock of the preceding figures and a magnification of part of the lock.

To understand the advantages of the present invention reference is made to FIG. 7, which shows an opening attempt with dexterity by shock, foiled by the present invention.

As a matter of facts, if one would open the lock 1 with dexterity by shock, the movable element 3 should be retracted, so as to free the radial movement space of the stop bar 81 in order to unlock the rotation of the rotor 6 with respect to the stator 9. Typically, to do this a rotational moment is continuously applied on the rotor 6, for example with a tensioner T1, and an impulsive force is applied, for example with a hammer T2, directed parallel to the direction of movement of the movable element 6, which, in the absence of the expedient devices of the present invention, gradually wins through micro-movements the force of the spring 4, displacing into the unlocking position.

The continuous application of the moment given by the lever or tensioner T1 would thus generate the rotation of the rotor 6 as soon as the movable element has been displaced (although temporarily) into the unlocking position.

On the contrary, thanks to the presence of anti-shock shaped portion 31 of the movable element 3 interacting with the engagement means 8, when a condition of an opening attempt with dexterity by shock—like the one just described—occurs, the unlocking of the lock 1 does not occurs: as a matter of facts, the anti-shock shaped portion 31 of the movable element 3 is intercepted during its movement by the engagement means (the terminal end) 8 of the stop bar 81 thus realizing the anti-shock function.

To understand this latter in its entirety, it must be clear that the application of the moment (with the tensioner T1) generates a small rotation (given the normal dimensional tolerances in these embodiments) of the rotor 6 in the hole 91; such small rotation generates, in turn, a small radial displacement of the stop bar 81, whose end 8 radially moves inwards until abutting on the cylindrical body of the movable element 3 that is in the extended condition (the solenoid being de-energized and, therefore, subject only to the force of the spring 4).

It becomes then clear that the subsequent application of an impulsive force (produced for example with the hammer T2) does not cause the displacement of the movable element 3 into the unlocking position, since the head of the stop bar 8 interferes with the enlarged head of the movable element 3, preventing its movement into the unlocking or opening position.

Several variants to what taught so far with regard to this first embodiment are obviously possible.

Figure 8:
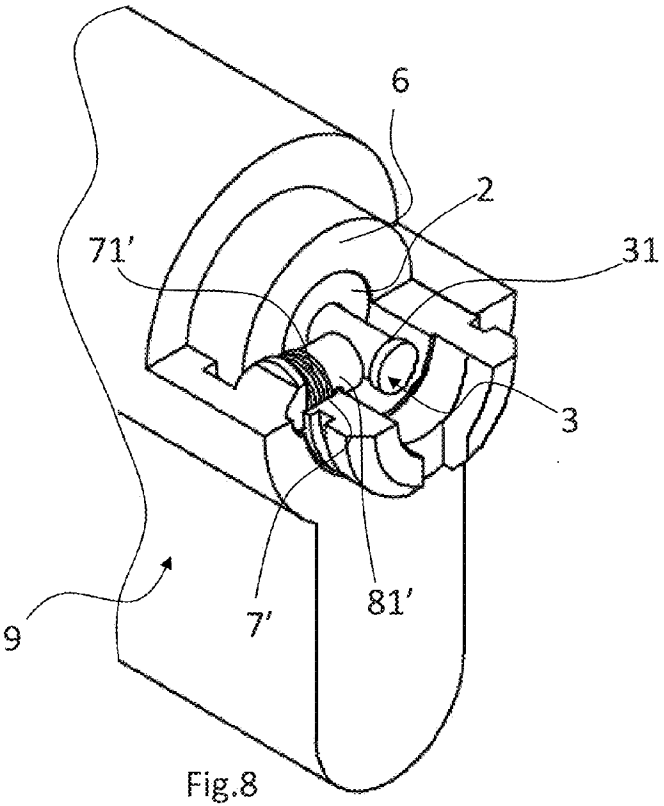
FIG. 8 shows a variant of the lock of the preceding figures.

A first variant is shown by way of example in FIG. 8, in which the same reference numbers denote the same parts with the same function, on which therefore we do not return anymore for conciseness's sake.

The only difference with respect to the embodiment described before with reference to FIGS. 1-7 is relevant to the stop bar 81, which in this case is in the form of a cylindrical pin 81'.

The seat 7 in the rotor 6, which before had a dead-end, is now replaced by a through seat 7' to allow the pin 81' to extend radially in the direction of the movable element 6.

The springs 71 are replaced by the sole spring 71' concentric to the pin 81', which has the same function as the former springs.

The functioning is completely similar to that described above and, therefore, we do not linger over.

Figure 10:
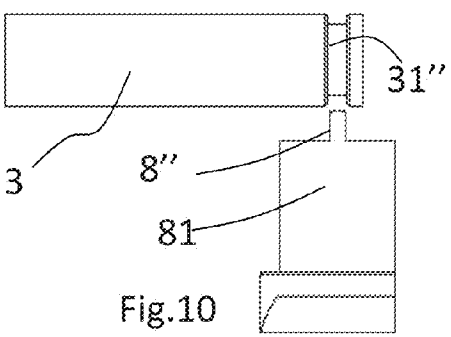
FIGS. 9-11 show different variants of parts of the lock of the preceding figures.
Figure 9:
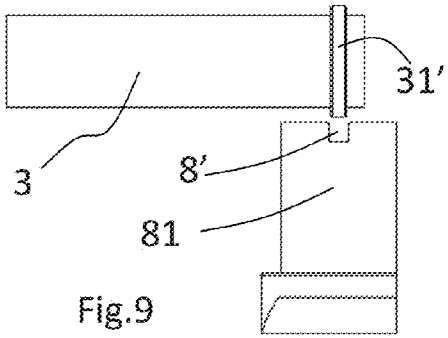
Figure 11:
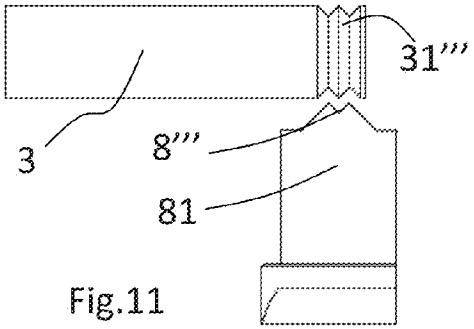

Always with regard to variants of this embodiment, reference is now made to FIGS. 9-11, which show some non-limiting examples of modifications to the anti-shock shaped portion 31',31",31'" of the movable element 3 and, correspondingly, to the engagement means of the stop bar 81, 81' intended to cooperate with it.

In particular, as shown in FIG. 9, the anti-shock shaped portion 31' comprises an annular protrusion projecting from the outer surface of the movable element 3 intended to cooperate with a corresponding and complementary cavity obtained on the head of the bar 81 (but, equivalently, of the bar 81'), which therefore forms the engagement means 8'.

Instead, in FIGS. 10 and 11, the shaped portions 31", 31'" comprise annular cavities obtained in the body of the movable element 3 and intended to cooperate with corresponding and complementary teeth made on the head of the bar 81 (but, equivalently, of the bar 8'), which form the engagement means 8" e 8'".

Obviously, as shown, the shape of cavities and teeth as well as their number may change depending on the needs, being for example one (as in FIG. 10), two (as in FIG. 11) or more.

The objects mentioned above are thus achieved.

Other variants to what has been taught so far are then furthermore possible, all these variants to be regarded as integral part of the invention, within the skill of the expert in the art in the light of the teachings provided so far.

The invention claimed is:

1. An electromechanical lock (1), comprising:

a solenoid (2)

a movable locking element (3) displaceable by said solenoid (2) into an unlocking position of the lock (1)

a spring (4) acting on said movable element (3) to hold the movable element in a locking position of the lock (1) with the solenoid (2) in a de-energized condition wherein said movable element (3) comprises an anti-shock shaped portion (31,31',31",31'") and said lock (1) comprises an engagement means (8,8',8",8'") for said anti-shock shaped portion, said engagement means (8,8',8",8'") being displaceable into an engagement position in which the engagement means interferes with the anti-shock shaped portion (31,31',31",31'") in order to prevent said movable element (3) from displacing into the unlocking position of the lock wherein the electromechanical lock further comprises a substantially cylindrical and hollow rotor (6), intended to house said solenoid (2) and said movable element (3) such that one end of the movable element provided with said anti-shock shaped portion (31) externally protrudes from said solenoid (2)

a fixed block or stator (9)

a stop bar (81) radially displaceable from and towards an interference position between rotor (6) and stator (9) to allow or prevent rotation of the former with respect to the latter.

2. An electromechanical lock (1) according to claim 1, wherein said anti-shock shaped portion (31,31',31",31'") of said movable element (3) comprises first abutment surfaces and said engagement means (8,8',8",8'") comprises second abutment surfaces to realise a mechanical interference between said movable element (3) and said engagement means (8,8',8",8'"), so as to engage the movable element (3) and to retain the movable element in the locking position of the lock.

3. An electromechanical lock (1) according to claim 1, wherein said movable element (3) is the movable core of said solenoid (2) and has a substantially cylindrical shape with two free ends, a first end being intended to cooperate with said spring (4) and the opposite end being provided with said anti-shock shaped portion (31,31',31",31'").

4. An electromechanical lock (1) according to claim 1, wherein said anti-shock shaped portion (31) comprises an enlarged head of said movable element (3).

5. An electromechanical lock (1) according to claim 1, comprising an electronic control unit (5), operatively connected to the solenoid (2) and in turn comprising an electronic card (51) and a connector element (52) optionally provided with an anti-drilling protection, said control unit being houseable inside said rotor (6).

6. An electromechanical lock (1) according to claim 1, said stop bar (81) having a substantially "L" shape and being provided with a bent end comprising said engagement means (8).

7. An electromechanical lock (1) according to claim 1, wherein said stop bar (81) is in the form of a cylindrical pin (81').

8. An electromechanical lock (1) according to claim 1, wherein said anti-shock shaped portion (31',31",31'") of the movable element (3) or alternatively said engagement means (8',8",8'") comprise teeth and said engagement means (8', 8",8'") or alternatively said anti-shock shaped portion (31', 31",31'") of the movable element (3) comprise cavities complementary to said teeth.

* * * * *